United States Patent [19]

Winkler

[11] Patent Number: 4,606,195

[45] Date of Patent: Aug. 19, 1986

[54] HYPERBARIC CONTAINER

[76] Inventor: Richard C. Winkler, 26 Rondeau, Kirkland, Quebec, Canada, H9H 3V4

[21] Appl. No.: 711,626

[22] Filed: Mar. 14, 1985

[51] Int. Cl.[4] ..... F17C 1/00

[52] U.S. Cl. ..... 62/45; 62/384; 62/457; 62/514 R

[58] Field of Search ..... 62/384, 457, 514 R, 62/45

[56] References Cited

U.S. PATENT DOCUMENTS

| | | | |
|---|---|---|---|
| 2,984,994 | 5/1961 | Hankins | 62/457 |
| 3,410,109 | 12/1968 | Maryland | 62/457 |
| 3,605,431 | 9/1971 | Carson | 62/457 |
| 3,820,355 | 6/1974 | Olivares | 62/384 |
| 3,959,982 | 6/1976 | Denis et al. | 62/457 |
| 4,288,996 | 9/1981 | Roncaglione | 62/384 |

*Primary Examiner*—Ronald C. Capossela

[57] ABSTRACT

A hyperbaric storage device has a walled inner and outer containers, a compressed gas supply contained within the device, a conduit from the gas supply to the inner container, a control valve for the conduit responsive to pressures above and below a superatmospheric pressure valve for closing and opening the valve.

20 Claims, 4 Drawing Figures

HYPERBARIC CONTAINER

This invention relates to a protective storage device.

The storage device in accord with the invention is required because a great number of goods, from raw materials to finished products, are extremely susceptible to damage or deterioration when exposed to an environment hostile to their intrinsic properties. Such goods include: pharmaceuticals, computer tapes and discs, photographic and biological materials. Storage for such materials and others without damage or deterioration is required during handling, shipping and storage. Such materials and others, with present arrangements are often exposed to: temperature or humidity outside critical limits, to fire, to contaminants such as dusts, gases, vapors, biological or chemical agents, which exposure and/or contamination can create unnecessary and, at times, irreplaceable losses.

Present methods and devices for avoiding such damage, deterioration and losses are divided between those whose high cost renders them prohibitively expensive for most applications and those of modest cost which are inadequate in most situations.

It is an object of the invention to provide a storage device which is of modest cost and, within its basic design, is adaptable by selection of materials to reduce losses, deterioration and damage of the type listed.

It is an object of the invention to provide a storage device comprising an inner container and an outer container arranged to provide a space between them, substantially surrounding the inner container, and referred to herein as a plenum. A pressurized gas supply is provided inside the device and arranged to provide gas under pressure to the inner container and means responsive to the pressure inside the inner container controls the gas so that such gas is supplied only when the pressure inside the inner container falls below a predetermined value which will be selected to be slightly above the ambient pressure for the container. It will readily be seen that even though there may be leakage through the walls of the inner container; such leakage, in view of the pressure differential, will be outwardly effectively preventing the ingress of corrosive or dirty gases, particles or of high or low temperature ambient gases. The plenum and outer container supply an insulating layer about the inner container further adding to the protection and having other functions in preferred forms of the invention. The plenum is almost totally sealed but, in most applications will be provided, at a convenient location, with an vent aperture to the outside to allow equalization of pressure between the inside and the outside of the outer wall.

In an preferred form of the device referred to in the preceding paragraph the gas supply is also connected to supply gas to the plenum. A temperature sensor is provided to sense the temperature inside, either the plenum or the inner container. When the temperature sensed rises above a predetermined valve, a valve is opened to provide gas from the supply to the plenum. The expansion of gas in the plenum and the circulation of the gas from the supply to the vent therein (which largely replaces the hot gas by cooler gas) both act to cool and maintain cool the plenum and have the same effect on the inner container thus acting to protect the contents of the inner container from the exterior conditions causing the temperature rise. The gas supply here is to the plenum. However, the sensor may be in the plenum or in the inner container. In the plenum the detection of the temperature rise will be early and the correctional action of the gas will be relatively small and should well precede any critical condition inside the inner container. If the sensor is in the inner container, it will only reflect, with a delay, the existence of a critical condition outside the outer container or in the plenum. Further conditions in the plenum will usually have deviated more greatly from those desired by the time an abnormal conditioner is detected if the detection is made in the inner container rather than in the plenum. Accordingly, with the temperature detector in the inner container, the requirement for plenum-released gas is less frequent but more gas will be required to correct the situation. With regard to the gas released in the plenum, its function in replacing the existing gas in the plenum is considered more significant and effective than its function in cooling due to gas expansion.

The devices referred to in the object paragraphs above are useful for a very large number of purposes including those described in the second paragraph of this application. It will be obvious that the materials of the inner and outer container will vary widely depending on function and environment. Similar variations will occur in the nature of the gas used. As examples only it will frequently be suitable to make the outer container of low thermal conductivity material of high insulation value. The same criteria may apply to the inner container although it may be necessary to provide the inner container with a metal lining or with special sealing means. Frequently some insulating or other quality of a container wall will be sacrificed to some degree for some other quality, e.g. strength, or magnetic or radiation shielding. As with the containers, the choice of gas may vary widely. Usually a relatively inexpensive, relatively inert gas such as air or carbon dioxide will be chosen but considering the range of purposes available the choice of gas may vary widely.

In drawings which illustrate a preferred embodiment of the invention:

Figure 1:
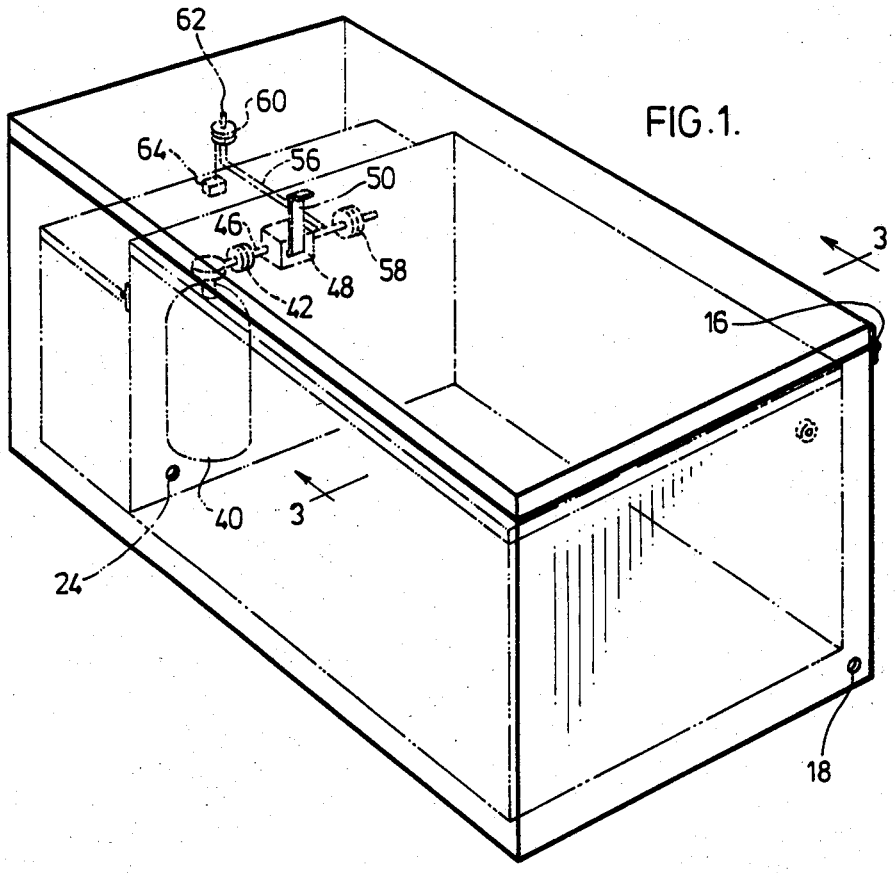
FIG. 1 is a perspective view of a device in accord with the invention.
Figure 2:
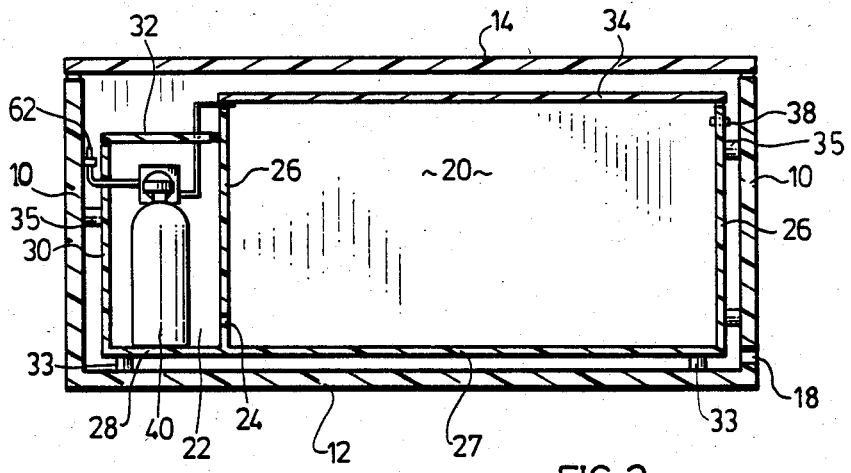
FIG. 2 is a longitudinal section of the device.
Figure 3:
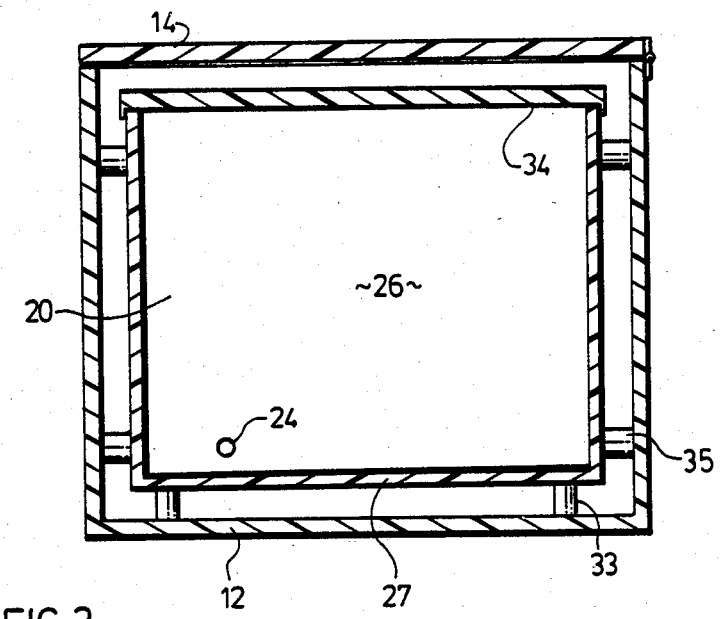
FIG. 3 is a transverse cross-section of the device.
Figure 4:
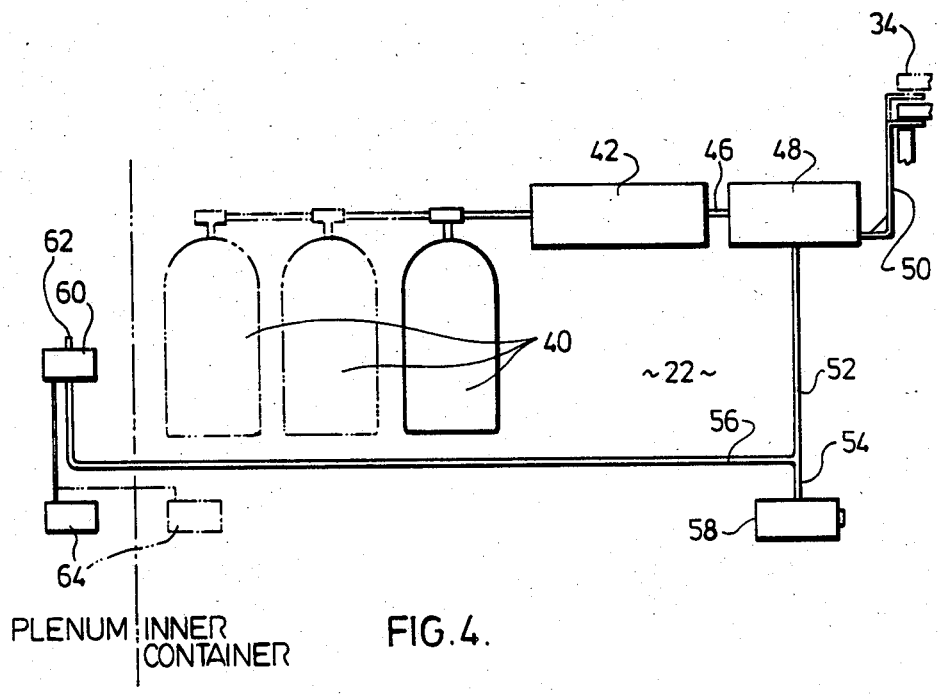
FIG. 4 is a schematic view showing the relationship of the functional portions of the gas supply.

In the drawings FIGS. 1, 2 and 3 indicate the physical arrangement of the components while FIG. 4 shows schematically the connections and elements of the gas supply without regard for their relative physical location.

In the drawings an outer container comprises side walls 10 and bottom wall 12 and removable top wall 14 which may be hinged at 16 to move between closed and opened position. Alternatively the top wall could be constructed to be merely lifted off and on or openable or removable in any other manner. The top wall 14 is preferably designed to make reasonably gas tight seal with the remainder of the outer container. A small venting recess 18 is provided preferably in the lower portion of one of the side walls of the outside container. The location of such vent aperture 18 will be located approximately opposite the plenum opening of the gas supply to be described. The venting recess 18 allows exit of gas from the plenum and equalization of pressure across the outer container walls. As previously described, the material of the outer container is made of any suitable material but, for most applications, will be of fireproof, low thermal conductivity, material.

An inner container is designed to fit within the outer container. The inner container as shown may be considered as in two sections, a main section 20 defined by side walls 26 and bottom wall 27 to receive the contents to be shipped and a supplementary section 22 defined by side walls 30 and one side wall 26, as shown, bottom wall 28 and top wall 32. Top wall 32 will be made removable to allow access to the equipment therein. Section 22 houses the gas supply and most of the controls as will be described. It will be noted that a vent aperture 24 connects the supplementary and main sections of the inner container to allow equalization of pressure between sections 20 and 22 of the inner container. Supports and abutments 33 and 35 space the inner container walls from those of the outer to leave an air space, referred to herein as a plenum, substantially surrounding the inner container compressing wall-enclosed sections 20 and 22 and surrounded by the outer container walls. The main section 20 of the inner container is provided with a removable top panel 34 for the inner container (usually a top panel) to allow insertion of goods in and removal of goods from the inner container. Such removable panel 34 is of course in general alignment with the removable panel 14 of the outer container. The inner and outer container panels may be designed for simultaneous operation on a hinged connection or may be designed for separate removal as shown. The sealing connection between the inner container panel 34 and the inner container side walls 26 is made as gas tight as possible, it being understood that one main purpose of the gas supply is to replace gas leakage out of the inner container either about the panel or otherwise. The inner container is preferably provided with emergency pressure release means to prevent undue pressure built up from whatever cause. Such pressure release means may take the form of the safety valve schematically shown at 38 or could take the form of a "burst out" panel (not shown).

The gas supply will now be described. One two or more gas bottles or containers 40 containing gas under pressure are connected in parallel to pressure regulator 42. The gas used may be air, $CO_2$, or any other relatively inert and non-inflammable gas. The pressure regulator 42 is designed to supply the gas at only a few psi above the ambient pressure surrounding the container, (i.e. in the normal course, only a few psi above atmosphere). Such small pressure differential is all that is required in the slow gas flows required by the invention. The conduit 46 from the pressure regulator includes an on-off valve 48 controlled by the position of the inner container panel 34. A lever 50 projecting from the valve is located to be contacted by the panel 34 when the latter is lowered to seal the inner container, and at that time to be depressed by panel 34 opening valve 48 when the panel is closed. The lever 50 is lightly spring biased upwardly to move the valve 48 to closed position when the panel 34 is removed. The conduit 52 from the plunger valve 48 is divided into a first conduit 54 and a second conduit 56. The first conduit includes pressure sensitive valve 58 which opens into inner container section 22. The sensor for valve 58 is part of the valve itself and it will be noted that the valve 58 is located in the section 22 which is in communication with the main section 20 of the inner container through vent 24. The pressure sensor of valve 58 is set to open when the pressure falls below a predetermined value which will be only a small amount above the ambient pressure surrounding the outer container and of course below that supplied by the pressure regulator. The valve sensor therefore operates to maintain the pressure in the sealed inner container slightly above the ambient pressure. Thus, all leakage from the inner container results in outward flow of gas and no contaminating gas or particles can enter the inner container. When the pressure in the inner container is at its required super-ambient level the valve 58 is shut off and when such inner container pressure falls below the predetermined level the valve 58 opens to supply gas to sections 20 and 22 of the inner container until the desired pressure level is again reached shutting off valve 58.

A second conduit 56 from the pressure regulator has a temperature sensitive valve 60 and passes to an outlet 62 into the plenum. The temperature sensor 64 for the temperature sensitive valve 60 is also located in the plenum. The sensor 64 is designed to detect temperatures over a predetermined value and in response to this to open the valve 60 to supply gas from regulator 42 to displace that already in the plenum. When the temperature in the plenum is below the predetermined value sensor 64 causes the valve 60 to close and halt the gas supply to outlet 62. The effect of the temperature-controlled valve 60, when excess temperature is detected, is to cause the gas from the outlet 62 to effectively replace the gas in the plenum with cooler gas from the gas supply. Thus, it is preferable if the vent 18 is approximately opposite the outlet 62 to ensure that most of the gas in the plenum is replaced. It is of course within the scope of the invention to provide baffles (not shown) in the plenum to provide a desired tortuous course of travel for gas from the outlet 62 to the vent. The gas from outlet 62, once flowing will continue to flow through the plenum until the temperature has fallen sufficiently to re-activate the sensor 64 and shut off the valve. It is within the scope of the invention, as previously discussed to place temperature sensor 64 inside the inner container (as indicated by the dotted lines of FIG. 4). The outlet 62 will remain in the plenum. In such alternative the temperature setting of valve 60 will probably be lower than when sensor 64 is in the plenum, since a given temperature rise in the inner container indicate a more critical situation than the same temperature in the plenum.

FIG. 4 also indicates, with additional gas bottles or containers 40, that a number of such bottles may collectively form the gas supply if desired.

The gas supply 40 and regulator 42 are shown as contained in the inner container. These may alternatively be contained in the plenum. If so, the pressure sensor of valve 58 and the outlet from the pressure sensitive valve 58 must, of course be contained in the inner container.

Physically, the device just described can be built in many variants. As an example the device can be built to fit as an accessory into the drawer of a standard filing cabinet. It can also be built as a small table top unit or even as a brief case. For larger applications, size is no limiting factor and the units can be built from the small to very large sizes. This safe transportation of sensitive goods through widely varying environmental conditions is assured since extreme temperature and humidity risks are precluded.

I claim:

1. Hyperbaric storage device comprising:

walled inner container, a first panel included in the walls of said inner container movable to expose an opening to the inside of said inner container in one position and, in another position, to seal to the remainder of said inner container walls to reduce leakage of gas therefrom, a walled outer container surrounding said inner container in spaced relationship to the walls of the latter to define a plenum chamber therebetween, a second panel included in the walls of the outer container movable to allow access to said first panel and through said opening to the inside of said inner container, a compressed gas supply contained within said device, a conduit from said gas supply to an outlet in said inner container, control valve for said conduit, said control being responsive to pressures above and below a predetermined value for closing and opening said valve respectively, said value being above atmospheric pressure, wherein a vent in said outer container wall allows said plenum to be normally at ambient pressures; and wherein a second conduit extends from said gas supply to open into said plenum, second control valve for said second conduit, temperature sensor located inwardly of said device, said second control valve and said temperature sensor being designed to open and close said second valve for temperatures above and below, respectively, a predetermined temperature.

2. Hyperbaric container as claimed in claim 1 wherein said temperature sensor is located in said plenum.

3. Hyperbaric container as claimed in claim 2 wherein a pressure regulator is connected to receive the gas from said gas supply and to provide gas of regulated pressure to each of said conduits.

4. Hyperbaric container as claimed in claim 1 wherein said temperature sensor is located in said inner container.

5. Hyperbaric container as claimed in claim 4 wherein a pressure regulator is connected to receive the gas from said gas supply and to provide gas of regulated pressure to each of said conduits.

6. Hyperbaric container as claimed in claim 1 wherein a pressure regulator is connected to receive the gas from said gas supply and to provide gas of regulated pressure to each of said conduits.

7. Hyperbaric container as claimed in claim 6 including a valve connected to and designed to open or close the connection between said regulator and said first and second conduits dependant upon whether said first panel is in said another position or not.

8. Hyperbaric storage device comprising:

an outer container, an inner container contained in said outer container and spaced therefrom to define a plenum, first access means on said inner container designed to assume an ooen and a closed position and, in said closed position to relatively closely seal said inner container against gas leakage, second access means on said outer container designed to allow access to said first access means and said inner container, a pressure regulated gas supply connected along a conduit to supply gas within a predetermined pressure range to said inner container, first valve means responsive to pressure in said inner container above and below a predetermined value for closing and opening said conduit, wherein said value is slightly higher than atmosphere pressure, wherein said pressure regulated gas supply is connected along a second conduit to supply gas within a predetermined pressure range to said plenum, second valve means responsive to temperature inside said device above and below a predetermined value for opening and closing said second conduit.

9. Hyperbaric storage device as claimed in claim 8 wherein:

said second valve means is so responsive to the temperature inside said inner container.

10. Hyperbaric storage device as claimed in claim 9 wherein third valve means is provided to allow or prevent gas flow to said first and second conduits responsive to said first access means being on a closed or opened position respectively.

11. Hyperbaric storage device as claimed in claim 8 wherein:

said second valve means is so responsive to the temperature inside said plenum.

12. Hyperbaric storage device as claimed in claim 11 wherein third valve means is provided to allow or prevent gas flow to said first and second conduits responsive to said first access means being on a closed or opened position respectively.

13. Hyperbaric storage device as claimed in claim 11 wherein additional valve means is provided to allow or prevent gas flow to said first and second conduits responsive to said first access means being on a closed or opened position respectively.

14. Hyperbaric storage device as claimed in claim 8 wherein additional valve means is provided to allow or prevent gas flow to said first and second conduits responsive to said first access means being on a closed or opened position respectively.

15. Hyperbaric storage device comprising:

walled inner container, a first panel included in the walls of said inner container movable to expose an opening to the inside of said inner container in one position and, in another position, to seal to the remainder of said inner container walls to reduce leakage of gas therefrom, a walled outer container surrounding said inner container in spaced relationship to the walls of the latter to define a plenum chamber therebetween, a second panel included in the walls of the outer container movable to allow access to said first panel and through said opening to the inside of said inner container, a compressed gas supply contained within said device, wherein a vent in said outer container wall allows said plenum to be normally at ambient pressures; and wherein a conduit extends from said gas supply to open into said plenum, a control valve for said conduit, temperature sensor located inwardly of said device, said control valve and said temperature sensor being designed to open and close said valve for temperatures above and below, respectively, a predetermined temperature.

16. Hyperbaric container as claimed in claim 15 wherein said temperature sensor is located in said plenum.

17. Hyperbaric container as claimed in claim 15 wherein said temperature sensor is located in said inner container.

18. Hyperbaric storage device comprising:

an outer container, an inner container contained in said outer container and spaced therefrom to define a plenum, first access means on said inner container designed to assume an open and a closed position and, in said closed position to relatively closely seal said inner container against gas leakage, second access means on said outer container designed to allow access to said first access means and said inner container, a pressure regulated gas supply, wherein said pressure regulated gas supply is connected along a conduit to supply gas within a predetermined pressure range to said plenum, valve means responsive to temperature inside said device above and below a predetermined value for opening and closing said second conduit.

19. Hyperbaric storage device as claimed in claim 18 wherein:

said valve means is so responsive to the temperature inside said inner container.

20. Hyperbaric storage device as claimed in claim 18 wherein:

said valve means is so responsive to the temperature inside said plenum.

* * * * *